US011487224B2

(12) United States Patent
Oikawa et al.

(10) Patent No.: US 11,487,224 B2
(45) Date of Patent: Nov. 1, 2022

(54) DEVELOPING DEVICE WITH ELASTIC FILM TO BLOCK AIR INPUT

(71) Applicant: HEWLETT-PACKARD DEVELOPMENT COMPANY, L.P., Spring, TX (US)

(72) Inventors: Mitsuru Oikawa, Gyeonggi-do (KR); Ohdug Kwon, Gyeonggi-do (KR); Yoshihiko Ichikawa, Gyeonggi-do (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/309,576

(22) PCT Filed: Feb. 18, 2020

(86) PCT No.: PCT/US2020/018562
§ 371 (c)(1),
(2) Date: Jun. 7, 2021

(87) PCT Pub. No.: WO2021/066872
PCT Pub. Date: Apr. 8, 2021

(65) Prior Publication Data

US 2022/0035273 A1 Feb. 3, 2022

(30) Foreign Application Priority Data

Oct. 1, 2019 (KR) ..... 10-2019-0121369

(51) Int. Cl.
*G03G 15/08* (2006.01)
*G03G 15/09* (2006.01)

(52) U.S. Cl.
CPC ..... *G03G 15/0921* (2013.01); *G03G 15/0812* (2013.01); *G03G 15/0815* (2013.01);
(Continued)

(58) Field of Classification Search
CPC ..... G03G 15/0921; G03G 15/0812; G03G 15/0891; G03G 15/0942; G03G 15/0815;
(Continued)

(56) References Cited

U.S. PATENT DOCUMENTS 5,129,357 A * 7/1992 Yamaji ..... G03G 15/0921 399/277
5,602,631 A 2/1997 Sakaguchi
(Continued)

FOREIGN PATENT DOCUMENTS

JP 2001183903 7/2001
JP 2019079028 5/2019
WO WO-2021194651 A * 9/2021

*Primary Examiner* — Walter L Lindsay, Jr.
*Assistant Examiner* — Laura Roth
(74) *Attorney, Agent, or Firm* — Trop Pruner & Hu, P.C.

(57) ABSTRACT

An example developing device includes a housing to contain a developer and having an opening, a developing sleeve provided in the housing and partially exposed to the outside of the housing through the opening, a magnetic member including a plurality of magnetic poles and located inside the developing sleeve, and an elastic member blocking an inflow of air through a space between a downstream edge of the opening in a rotation direction of the developing sleeve and an outer circumferential surface of the developing sleeve. The elastic member includes a fixed portion fixed to the housing at a position adjacent to the downstream edge of the opening and an extension portion extending from the fixed portion in a bent form in the rotation direction of the developing sleeve to be elastically in contact with the surface of the developing sleeve.

15 Claims, 16 Drawing Sheets

(52) U.S. Cl.
CPC ..... *G03G 15/0891* (2013.01); *G03G 15/0898* (2013.01); *G03G 15/0942* (2013.01); *G03G 2215/0609* (2013.01)

(58) Field of Classification Search
CPC ..... G03G 15/0817; G03G 15/0898; G03G 2215/0609
See application file for complete search history.

(56) References Cited

U.S. PATENT DOCUMENTS

| | | | | |
|---|---|---|---|---|
| 5,781,835 | A * | 7/1998 | Okano | G03G 15/0921 399/267 |
| 6,035,158 | A * | 3/2000 | Asakura | G03G 15/0131 399/101 |
| 7,013,104 | B2 | 3/2006 | MacMillan | |
| 7,236,729 | B2 | 6/2007 | Askren | |
| 7,620,352 | B2 | 11/2009 | Kawahara | |
| 8,369,737 | B2 | 2/2013 | Sakamoto | |
| 2010/0150603 | A1* | 6/2010 | Sakamoto | G03G 15/0898 399/103 |
| 2017/0115606 | A1* | 4/2017 | Sakamaki | G03G 15/0893 |
| 2019/0018346 | A1 | 1/2019 | Ogasawara | |
| 2019/0121254 | A1 | 4/2019 | Ogasawara | |

* cited by examiner

DEVELOPING DEVICE WITH ELASTIC FILM TO BLOCK AIR INPUT

BACKGROUND

An image forming apparatus using an electrophotographic method forms a visible toner image on a photoconductor by supplying toner to an electrostatic latent image formed on the photoconductor, transfers the toner image to a print medium, fixes the transferred toner image on the print medium, and prints an image on the print medium. A developing device contains the toner therein and supplies the toner to the electrostatic latent image formed on the photoconductor to form the visible toner image on the photoconductor.

When air flows into the developing device during rotation of a developing roller in a printing process, air pressure inside the developing device may increase. When the air pressure inside the developing device increases, toner scattering causing leakage of toner from the developing device may occur.

BRIEF DESCRIPTION OF DRAWINGS

Various examples will be described below by referring to the following figures.

DETAILED DESCRIPTION OF EXAMPLES

Figure 1:
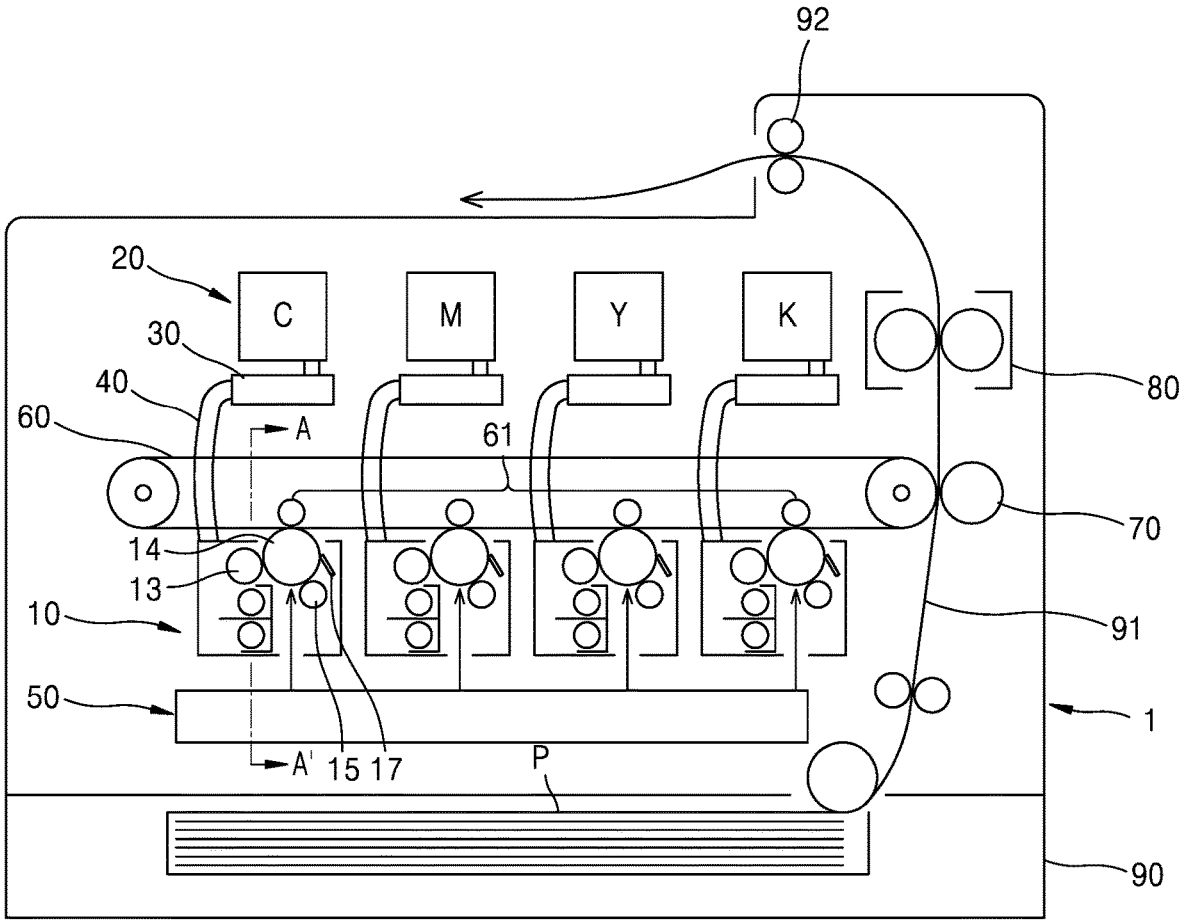
FIG. 1 is a view schematically illustrating an electrophotographic image forming apparatus according to an example.

FIG. 1 is a view schematically illustrating an electrophotographic image forming apparatus according to an example.

Referring to FIG. 1, an electrophotographic image forming apparatus 1 may print an image by using an electrophotographic method. In an example, the printed image may be a color image. The image forming apparatus may include a plurality of developing devices 10, an exposure unit 50, a transfer unit, and a fusing unit 80. The image forming apparatus may include a plurality of developer cartridges 20. The plurality of developer cartridges 20 are connected to the plurality of developing devices 10, respectively, and developers contained in the plurality of developer cartridges 20 are supplied to the plurality of developing devices 10, respectively. A developer supply unit 30 may be between each of the developer cartridges 20 and each of the developing devices 10. The developer supply unit 30 may receive the developer from the developer cartridge 20 and supply the received developer to the developing device 10 via a supply pipe 40. Although not shown in the drawings, the developer supply unit 30 may be omitted and the supply pipe 40 may directly connect the developer cartridge 20 with the developing device 10.

The plurality of developing devices 10 may include a plurality of developing devices 10C, 10M, 10Y, and 10K for forming toner images of cyan (C), magenta (M), yellow (Y), and black (K) colors. In addition, the plurality of developer cartridges 20 may include a plurality of developer cartridges 20C, 20M, 20Y, and 20K respectively containing toners of cyan (C), magenta (M), yellow (Y), and black (K) colors to be supplied to the plurality of developing devices 10C, 10M, 10Y, and 10K. Hereinafter, a printer including the plurality of developing devices 10C, 10M, 10Y, and 10K and the plurality of developer cartridges 20C, 20M, 20Y, and 20K will be described, and reference numerals with letters C, M, Y, and K respectively denote elements for developing C, M, Y, and K images unless otherwise stated.

Each of the developing devices 10 may include a photosensitive drum 14 on which an electrostatic latent image is formed, and a developing roller 13 for supplying a toner to the electrostatic latent image and developing the electrostatic latent image into a visible toner image. A charging roller 15 is a charger for charging a surface of the photosensitive drum 14 to a uniform surface electric potential. A charging brush or a corona charger may also be used instead of the charging roller 15. The developing device 10 may further include a charging roller cleaner (not shown) for removing a foreign material such as toner or dust attached to the charging roller 15, a cleaning member 17 for removing toner remaining on a surface of the photosensitive drum 14 after an intermediate transfer process which will be described below, and a regulating member 16 (see FIG. 3) for regulating the amount of toner supplied to an area where the photosensitive drum 14 and the developing roller 13 face each other. The cleaning member 17 may include, for example, a cleaning blade that contacts the surface of the photosensitive drum 14 and scrapes toner.

The exposure unit 50 emits light modulated to correspond to image information to the photosensitive drum 14 and forms an electrostatic latent image on the photosensitive drum 14. A laser scanning unit (LSU) using a laser diode as a light source or a light-emitting diode (LED) exposure unit using an LED as a light source may be used as the exposure unit 50.

Toner may be supplied to the photosensitive drum 14 by a development bias voltage applied between the developing roller 13 and the photosensitive drum 14, and an electrostatic latent image formed on the surface of the photosensitive drum 14 may be developed into a visible toner image.

The transfer unit transfers the toner image formed on the photosensitive drum 14 to a print medium P. In an example, a transfer unit using an intermediate transfer method is used. For example, the transfer unit may include an intermediate transfer belt 60, an intermediate transfer roller 61, and a transfer roller 70. A plurality of intermediate transfer rollers 61 are located to face the photosensitive drums 14 of the plurality of developing devices 10C, 10M, 10Y, and 10K with the intermediate transfer belt 60 therebetween. An intermediate transfer bias voltage for intermediate-transferring the toner images respectively developed on the photosensitive drums 14 to the intermediate transfer belt 60 is applied to the plurality of intermediate transfer rollers 61. A corona transfer unit or a transfer unit using a pin scorotron method may be used instead of the intermediate transfer roller 61.

The transfer roller 70 is located to face the intermediate transfer belt 60. A transfer bias voltage is applied to the transfer roller 70 to transfer the toner images, which have been transferred to the intermediate transfer belt 60, to the print medium P.

The fusing unit 80 fixes the toner images transferred to the print medium P onto the print medium P by applying heat and/or pressure to the toner images. The fusing unit 80 is not limited to a shape shown in FIG. 1.

In this structure, the exposure unit 50 forms electrostatic latent images on the photosensitive drums 14 by scanning a plurality of light beams modulated to correspond to color image information to the photosensitive drums 14 of the plurality of developing devices 10C, 10M, 10Y, and 10K. The electrostatic latent images of the photosensitive drums 14 of the plurality of developing devices 10C, 10M, 10Y, and 10K are developed into visible toner images by using C, M, Y, and K toners supplied to the plurality of developing devices 10C, 10M, 10Y, and 10K from the plurality of developer cartridges 20C, 20M, 20Y, and 20K. The developed toner images are sequentially transferred to the intermediate transfer belt 60. The print medium P loaded on a feed unit 90 is fed between the transfer roller 70 and the intermediate transfer belt 60 along a feed path 91. The toner image intermediate-transferred to the intermediate transfer belt 60 is transferred to the print medium P by a transfer bias voltage applied to the transfer roller 70. When the print medium P passes through the fusing unit 80, the toner image is fixed to the print medium P by heat and pressure. When the fixing of the toner image is completed, the print medium P is discharged by a discharge roller 92.

Figure 2:
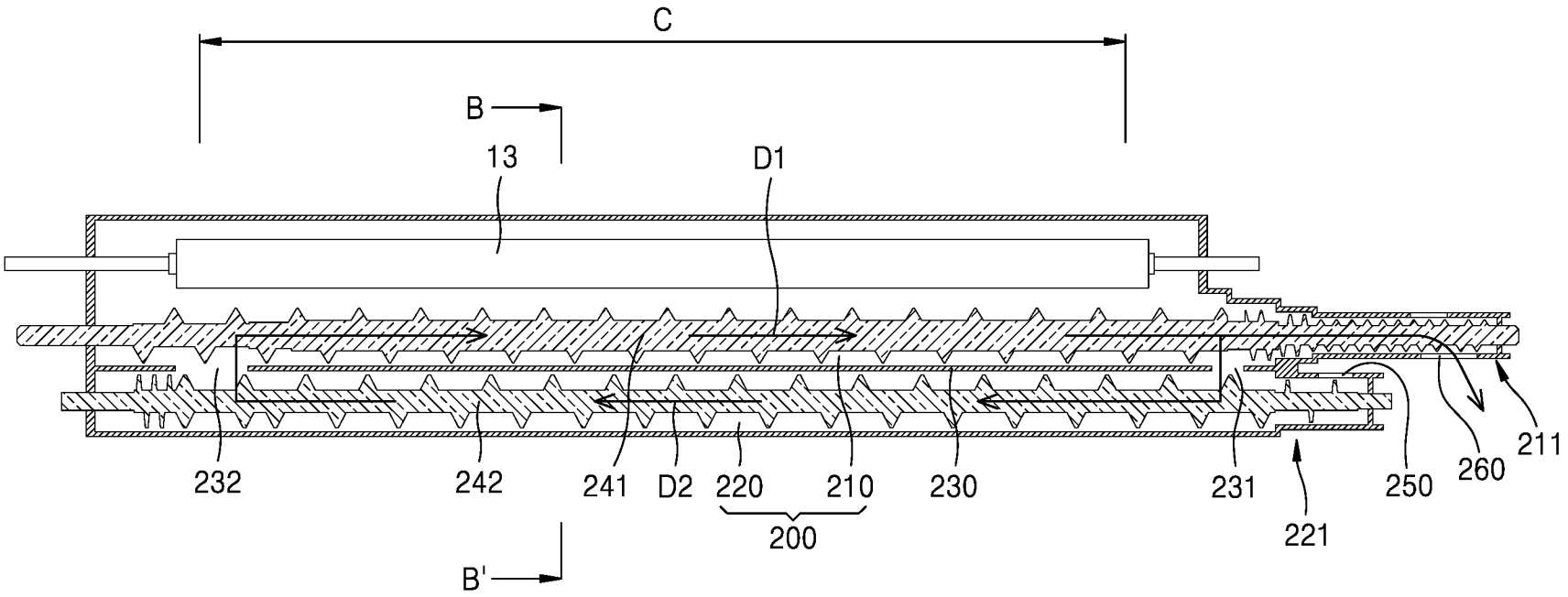
FIG. 2 is a cross-sectional view taken along line A-A' of the developing device shown in FIG. 1 according to an example.
Figure 3:
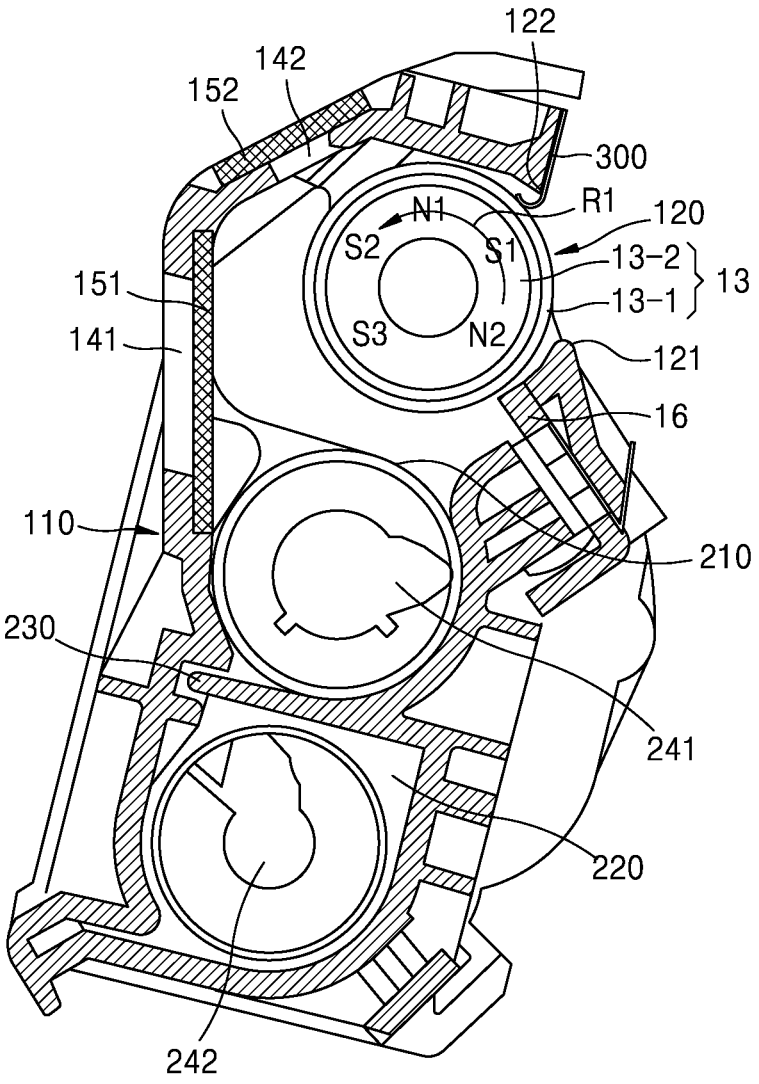
FIG. 3 is a cross-sectional view taken along line B-B' of the developing device shown in FIG. 2 according to an example.
Figure 4:
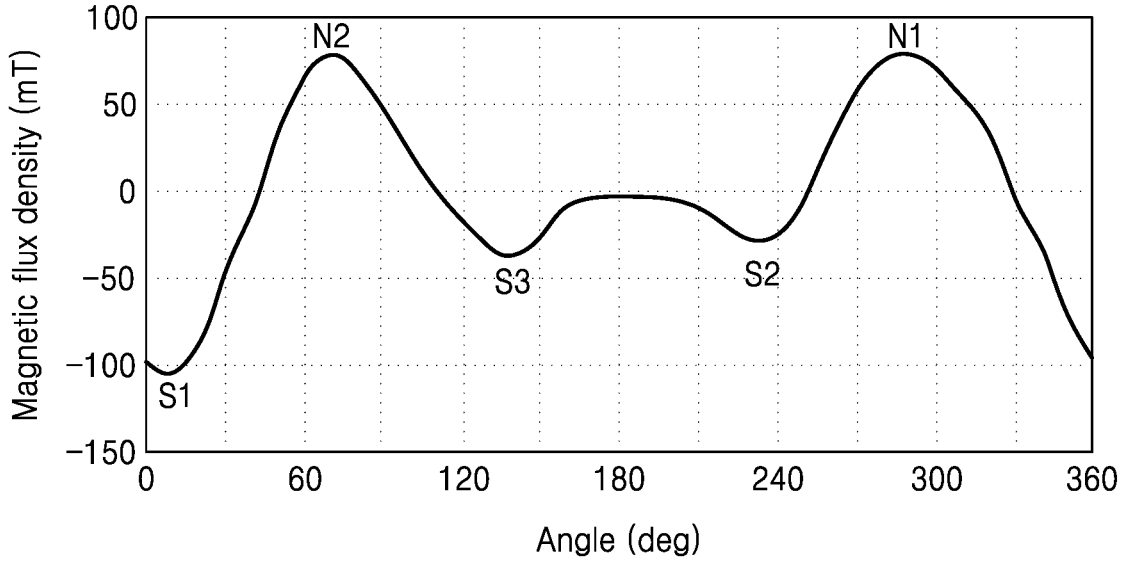
FIG. 4 is a graph illustrating magnetic flux density of a plurality of magnetic poles according to an example.

FIG. 2 is a cross-sectional view taken along line A-A' of the developing device shown in FIG. 1 according to an example. FIG. 3 is a cross-sectional view taken along line B-B' of the developing device shown in FIG. 2 according to an example. FIG. 4 is a graph illustrating magnetic flux density of a plurality of magnetic poles according to an example.

Referring to FIGS. 2 and 3, the developing device 10 is a two-component development-type developing device using a carrier and a toner. The developing device 10 includes a housing 110 having an opening 120, wherein the developing roller 13 is provided in the housing 110.

A developer may be contained in the housing 110. The developer may be supplied from the developer cartridge 20. A developer conveying path 200 is provided in the housing 110. The developer is transported along the developer conveying path 200 and agitated. The developing roller 13 is provided at the developer conveying path 200. The developer conveying path 200 may include a developing chamber 210 and an agitating chamber 220. The agitating chamber 220 is separated from the developing chamber 210 by a partition wall 230. The opening 120 is formed in the developing chamber 210. The opening 120 is open to the photosensitive drum 14. The developing roller 13 is provided in the developing chamber 210. A portion of the developing roller 13 is exposed to the outside of the developing chamber 210 through the opening 120, and the exposed portion of the developing roller 13 faces the photosensitive drum 14. The developing roller 13 supplies toner contained in the developing chamber 210 to the electrostatic latent image formed on the photosensitive drum 14 through the opening 120 to develop the electrostatic latent image into a toner image.

First and second conveying members 241 and 242 may be respectively provided in the developing chamber 210 and the agitating chamber 220. The first and second conveying members 241 and 242 agitate the toner and the carrier by transporting the developer contained in the developing chamber 210 and the agitating chamber 220 in the longitudinal direction. Each of the first and second conveying members 241 and 242 may be, for example, an auger with a spiral blade. The first and second conveying members 241 and 242 transport the developer in opposite directions. For example, the first and second conveying members 241 and 242 transport the developer in first and second directions D1 and D2, respectively. First and second communication holes 231 and 232 are respectively formed at both end portions of the partition wall 230 in the longitudinal direction so that the developing chamber 210 communicates with the agitating chamber 220. The developer in the developing chamber 210 is transported in the first direction D1 from the second communication hole 232 by the first conveying member 241. The developer is transported to the agitating chamber 220 through the first communication hole 231 provided at one end portion of the partition wall 230 in the first direction D1. The developer in the agitating chamber 220 is transported in the second direction D2 from the first communication hole 231 by the second conveying member 242. The developer is transported to the developing chamber 210 through the second communication hole 232 provided at the other end portion of the partition wall 230 in the second direction D2. In this structure, the developer circulates along a circulation path formed in an order of the developing chamber 210, the first communication hole 231, the agitating chamber 220, the second communication hole 232, and the developing chamber 210. Part of the developer transported in the developing chamber 210 in the first direction D1 is attached to the developing roller 13, and toner contained in the developer is supplied to the photosensitive drum 14.

The developer is supplied into the housing 110, i.e., into the developer conveying path 200, from the developer cartridge 20 through a developer supply hole 250. The developer supply hole 250 is formed outside an effective image area C of the developing roller 13. The effective image area C refers to a portion of the developing roller 13 in the longitudinal direction that is effectively used to form an image. A length of the effective image area C may be slightly greater than a width of the print medium P having a maximum available size. The effective image area C may be located between the first communication hole 231 and the second communication hole 232. The developer supply hole 250 may be formed outside the first communication hole 231 and the second communication hole 232.

In an example, the developing device 10 may include a developer supply unit 221 extending from the developer conveying path 200 in the longitudinal direction of the developing roller 13. The developer supply hole 250 may be formed in the developer supply unit 221. For example, the developer supply unit 221 may extend in the first direction D1 from an upstream side of the agitating chamber 220 in the second direction D2. The second conveying member 242 extends into the developer supply unit 221. The developer supplied to the agitating chamber 220 through the developer supply hole 250 is transported in the second direction D2 by the second conveying member 242.

The developing roller 13 may include a developing sleeve 13-1 and a magnetic member 13-2. The developing sleeve 13-1 is rotatably provided in the housing 110. The developing sleeve 13-1 is provided in the developing chamber 210, and a part of the developing sleeve 13-1 is exposed to the outside of the housing 110 through the opening 120 to face the photosensitive drum 14. The magnetic member 13-2 includes a plurality of magnetic poles and is located inside the developing sleeve 13-1 to generate a magnetic force. The magnetic member 13-2 does not rotate. The regulating member 16 is located at the upstream side of the opening 120 in a rotation direction of the developing sleeve 13-1 and regulates a thickness of the developer supplied to the opening 120. The regulating member 16 is located to be adjacent to an upstream edge 121 of the opening 120. The regulating member 16 is located to be spaced apart from the surface of the developing sleeve 13-1 at a regulation gap.

The plurality of magnetic poles may include a developing pole S1, and a conveying pole N1, a separating pole S2, a catch pole S3, and a regulating pole N2, which are sequentially arranged in the rotation direction of the developing sleeve 13-1 from the developing pole S1. The developing pole S1 faces the opening 120. The conveying pole N1 is located at a downstream side of the opening 120. The separating pole S2 separates the developer from the developing sleeve 13-1. The catch pole S3 attaches the developer inside the housing 110 to the developing sleeve 13-1. The regulating pole N2 faces the regulating member 16. The separating pole S2 and the catch pole S3 may have the same magnetic polarity. The developing pole S1 and the conveying pole N1 have opposite magnetic polarities. The developing pole S1 and the regulating pole N2 have opposite magnetic polarities. As illustrated in FIG. 4, the separating pole S2, the catch pole S3, and the developing pole S1 are S poles, and the conveying pole N1 and the regulating pole N2 are N poles.

A developer layer formed on an outer circumferential surface of the developing sleeve 13-1 by the magnetic force of the catch pole S3 is transported to the regulating pole N2 as the developing sleeve 13-1 rotates. Because a thickness of the developer layer is regulated while the developer passes between the developing sleeve 13-1 and the regulating member 16, the developer layer has a uniform thickness. The developer layer regulated to have a uniform thickness is transported to the developing pole S1 as the developing sleeve 13-1 rotates. Toner is attached to the electrostatic latent image formed on the surface of the photosensitive drum 14 from the developer layer formed on the surface of the developing sleeve 13-1 by the development bias voltage applied to the developing sleeve 13-1. After passing the developing pole S1, the developer remaining on the outer circumferential surface of the developing sleeve 13-1 is transported to the separating pole S2 via the conveying pole N1. At the separating pole S2, the developer is separated from the outer circumferential surface of the developing sleeve 13-1 by a repulsive magnetic field formed by the separating pole S2 and the catch pole S3 and dropped into the developing chamber 210. In this circulation structure, the developer with new toner attached thereon is supplied to the developing sleeve 13-1.

The developing device 10 may use an auto developer refill (ADR) method. The ADR-type developing device 10 discharges a surplus of the developer out of the housing 110 to maintain a constant amount of the developer in the housing 110. In this case, a small amount of a carrier as well as toner may be contained in the developer cartridge 20, and both the toner and the carrier may be supplied to the developing device 10 from the developer cartridge 20.

A developer outlet 260 for discharging the surplus of the developer may be provided in the housing 110. The discharged surplus developer may be contained in a waste developer container (not shown). The developer outlet 260 may be located outside the first communication hole 231 and the second communication hole 232. According to an example, the developing device 10 may include a developer discharge portion 211 extending from the developer conveying path 200 in the longitudinal direction of the developing roller 13. The developer outlet 260 may be formed in the developer discharge portion 211. For example, the developer discharge portion 211 may extend in the first direction D1 from the downstream side of the developing chamber 210 with respect to the first direction D1. The first conveying member 241 extends into the developer discharge portion 211. The surplus developer is transported by the first conveying member 241 and is discharged to the outside of the developing device 10 through the developer outlet 260. In this structure, deterioration of the carrier may be inhibited and a stable toner charge amount may be obtained, thereby improving image quality. In the ADR method, it is important to maintain a uniform amount of developer in the developing device 10. When the amount of the developer excessively decreases, an image defect called an auger mark may occur.

As the developing sleeve 13-1 rotates, air flows into the developing device 10. Air flow introduced into the developing device 10 is proportional to a rotation speed of the developing sleeve 13-1. As the process speed of the image forming apparatus increases and the size thereof decreases, the rotation speed of the developing sleeve 13-1 increases while the size of the developing device 10 decreases, and thus, pressure inside the developing device 10 increases. When the pressure inside the developing device 10 increases excessively, toner may scatter out of the developing device 10. In the ADR method, the developer may be excessively discharged with air through the developer outlet 260. In order to reduce an increase in the inner pressure of the developing device 10, air vents 141 and 142 may be provided at the housing 110, thereby discharging air out of the developing device 10. The air vents 141 and 142 may be provided with air filters 151 and 152 to filter the developer. When the developing device 10 is used for a long time, the air filters 151 and 152 may be contaminated (e.g., clogged) by the developer and thus the ability of discharging air may be lowered. Although an effect of inhibiting the increase in pressure may be increased by enlarging areas of the air vents 141 and 142, it is difficult to ensure sufficient areas for the air vents 141 and 142 due to the tendency of reducing the size of the developing device 10.

As the developing sleeve 13-1 rotates, air is discharged out of the developing device 10 through the regulation gap between the regulating member 16 and the developing sleeve 13-1 together with the developer and air is introduced into the developing device 10 through a gap between a downstream edge 122 of the opening 120 and the developing sleeve 13-1 together with the developer. When an amount of air introduced into the developing device 10 through the gap between the downstream edge 122 of the opening 120 and the developing sleeve 13-1 is more than an amount of air discharged out of the developing device 10 through the regulation gap between the regulating member 16 and the developing sleeve 13-1, air pressure inside the developing device 10 increases.

When the regulation gap is referred to as RG and a minimum value of the gap between the housing 110 and the developing sleeve 13-1 at the downstream side of the opening 120 is referred to as HG, an amount of air discharged and introduced through the regulation gap RG and the gap HG may be calculated by using a packing density PD of the developer layer on the developing sleeve 13-1, and a net air flow through the gap HG may be calculated based on the results.

The packing density PD may be calculated using Equation 1 below. In Equation 1, $T_c$ is a concentration of toner in the developer, $D_t$ is a true density of toner, $D_c$ is a true density of a carrier, DMA (developer mass per unit area) is an amount of a developer per unit area of the developing sleeve 13-1, and G is the regulation gap RG or the gap HG.

$$PD = \frac{\frac{T_C}{100} \times \frac{DMA}{D_t} + \frac{(100 - T_C)}{100} \times \frac{DMA}{D_C}}{G} \quad \text{Equation 1}$$

Figure 5:
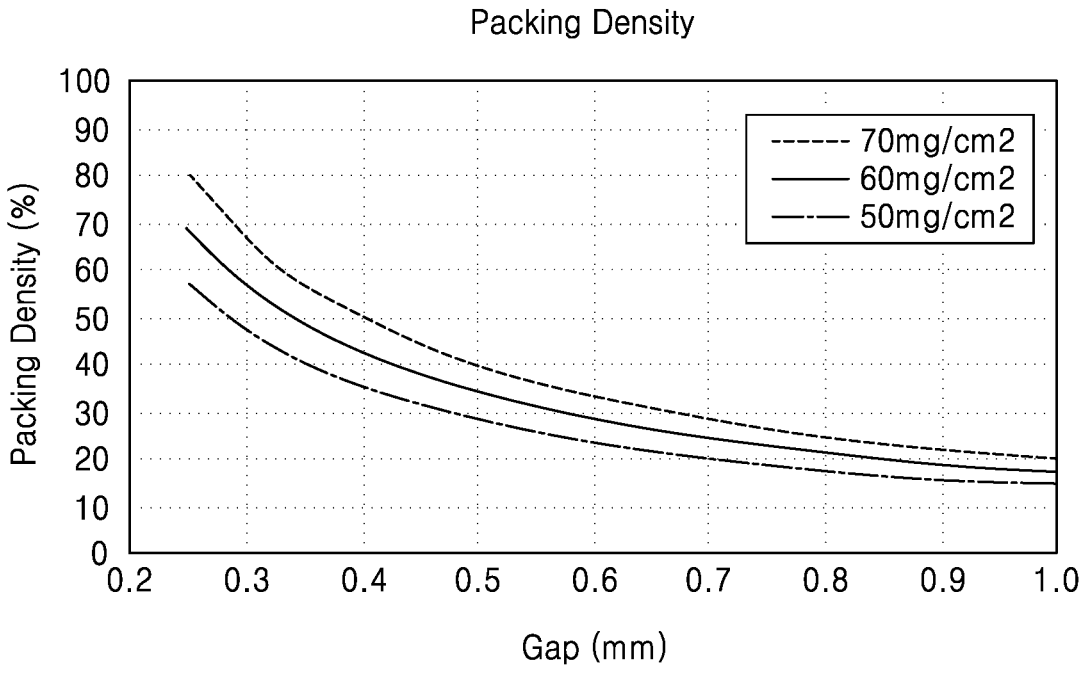
FIG. 5 is a graph illustrating packing density according to an example.

FIG. 5 is a graph illustrating packing density according to an example. In more detail, FIG. 5 is a graph illustrating calculation results of packing density PD while changing G values under the following conditions using Equation 1.

$T_c$: 9.89%

$D_t$: 1100 mg/cm$^3$ $D_c$: 4600 mg/cm$^3$

DMA: 50, 60, and 70 mg/cm$^2$

Referring to FIG. 5, a packing density PD is 40% when G=0.5 mm and DMA=70 mg/cm$^2$. This indicates that the developer accounts for 40% and air accounts for 60% among substances passing through the regulation gap RG or the gap HG by rotation of the developing sleeve 13-1. That is, air flows into or out of the developing device 10 while the developing sleeve 13-1 rotates.

Air flow Af may be calculated from the packing density PD. The air flow Af may be calculated using Equation 2 below. In Equation 2, PS is a process speed and WIDTH is a width of the developing sleeve 13-1 (i.e., width effectively used to transport the developer).

$$Af = G \times (1 - PD) \times PS \times \text{WIDTH} \quad \text{Equation 2}$$

Figure 6:
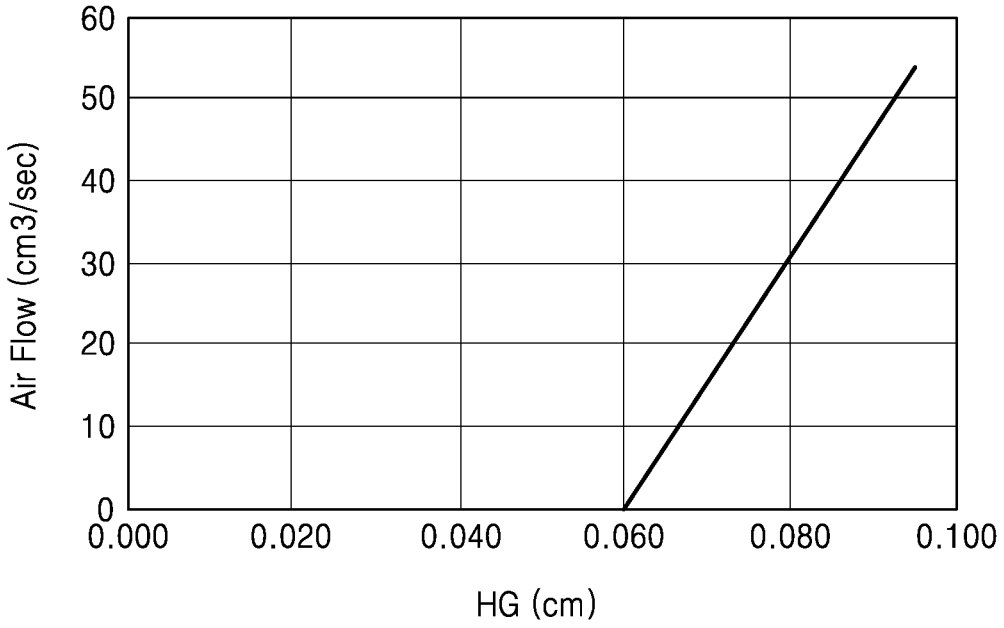
FIG. 6 is a graph illustrating calculation results of air flow introduced into a housing through a gap (HG) according to an example.

FIG. 6 is a graph illustrating calculation results of air flow introduced into a housing through a gap (HG) according to an example. In more detail, FIG. 6 is a graph illustrating calculation results of air flow introduced into the housing 110 through the gap HG while changing the gap HG under the following conditions using Equations 1 and 2.

$T_c$: 9.89%

$D_t$: 1100 mg/cm$^3$ $D_c$: 4600 mg/cm$^3$

DMA: 60 mg/cm$^2$

PS: 28 cm/sec

WIDTH: 31.3 cm

RG: 0.6 mm

Referring to FIG. 6, it may be confirmed that the amount of air introduced is '0' when RG≥HG, and the amount of air introduced rapidly increases when RG<HG. By maintaining the gap HG to be less than the regulation gap RG, the amount of air introduced may be lowered or '0'. However, when the gap HG is less than 0.5 mm, toner scattering may occur.

Figure 7:
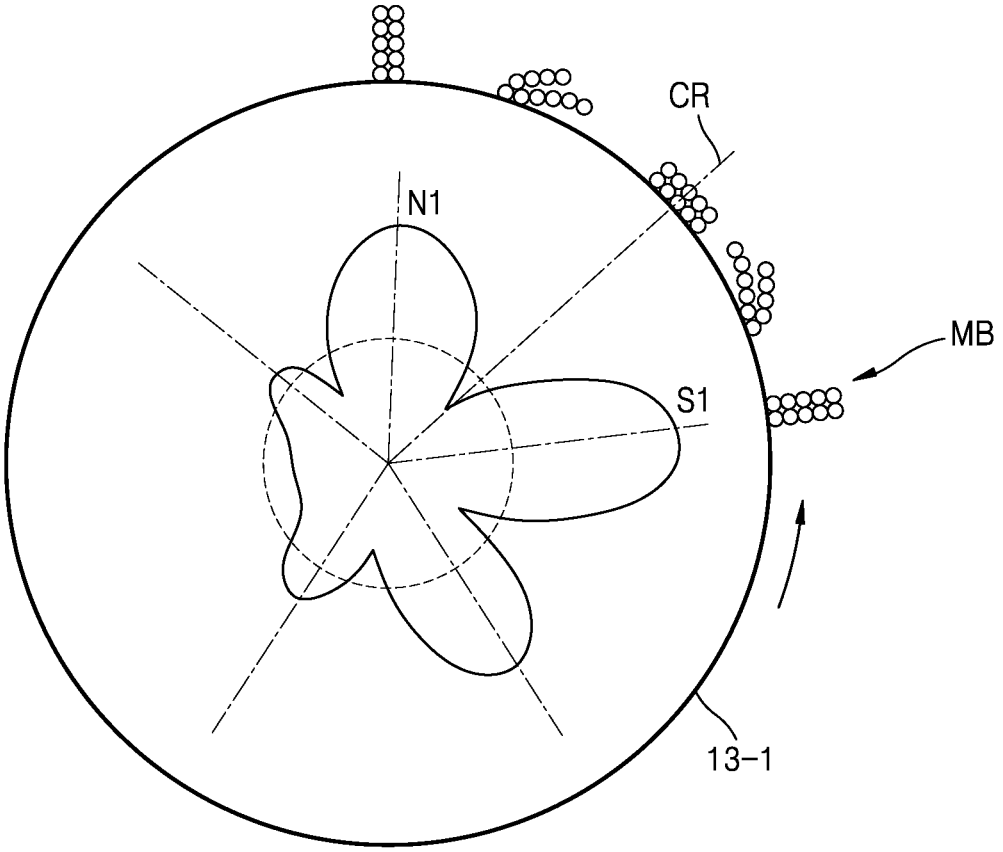
FIG. 7 is a diagram illustrating a shape of a developer layer formed on a developing sleeve according to an example.

FIG. 7 is a diagram illustrating a shape of a developer layer formed on a developing sleeve according to an example.

Referring to FIG. 7, the developer layer forms a magnetic brush MB on the developing sleeve 13-1 by a magnetic force provided by the magnetic member 13-2. The magnetic brush MB moves into the housing 110 through the gap HG as the developing sleeve 13-1 rotates. When the gap HG is less than 0.5 mm, the gap HG is lower than a height of the magnetic brush MB, and thus, the magnetic brush MB collides with an inner wall of the housing 110. In addition, when the gap HG is greater than 0.9 mm, toner scattering may occur. This is because a space may be formed between the magnetic brush MB and the inner wall of the housing 110 due to a larger gap than the height of the magnetic brush MB, and thus, toner may be scattered out of the housing 110 while air flows out of the housing 110 through the space by the air pressure inside the housing 110. In consideration thereof, the gap HG may be set in the range of 0.5 mm to 0.9 mm.

Referring again to FIG. 3, the developing device 10 of this example includes an elastic member 300 that blocks an inflow of air through the space between the developing sleeve 13-1 and the downstream edge 122 of the opening 120 in the rotation direction of the developing sleeve 13-1.

Figure 8:
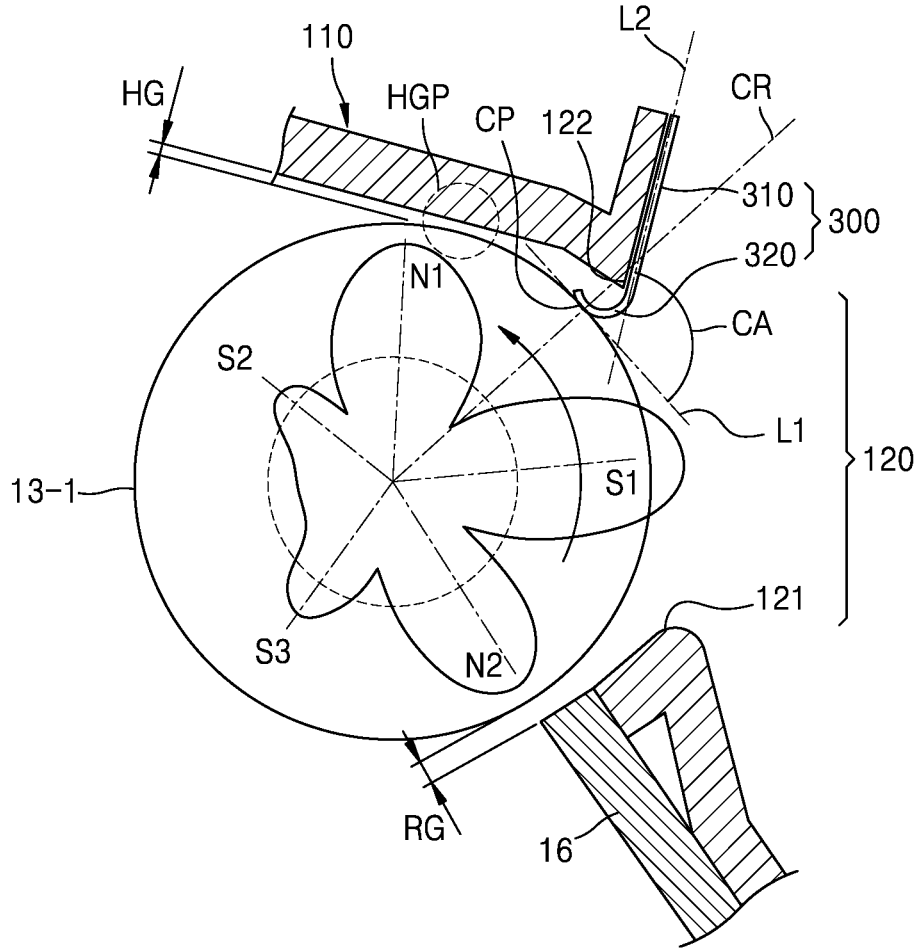
FIG. 8 is a diagram illustrating an elastic member according to an example.

FIG. 8 is a diagram illustrating an elastic member according to an example.

Referring to FIG. 8, the elastic member 300 includes a fixed portion 310 fixed to the housing 110 at a position adjacent to the downstream edge 122 of the opening 120 and an extension portion 320 extending from the fixed portion 310 in a bent form in a rotation direction R1 of the developing sleeve 13-1 to be elastically in contact with the surface of the developing sleeve 13-1. The fixed portion 310 may be fixed to the housing 110, for example, by using a double-sided tape. Although not shown in the drawing, the housing 110 may be provided with a support member and the fixed portion 310 may be attached to the support member. The elastic member 300 may have a film member with elasticity. For example, the elastic member 300 may be formed of a polyethylene (PE) film.

The extension portion 320 may be in contact with the developing sleeve 13-1 at an upstream portion, in the rotation direction of the developing sleeve 13-1, of a position HGP where the gap HG between the housing 110 and the developing sleeve 13-1 is minimized to block an inflow of air through the space between the downstream edge 122 of the opening 120 and the developing sleeve 13-1. That is, a contact portion CP between the extension portion 320 and the developing sleeve 13-1 is located at an upstream portion of the position HGP where the gap HG between the housing 110 and the developing sleeve 13-1 is minimized.

In order to effectively block the inflow of air, a contact pressure between the extension portion 320 and the developing sleeve 13-1 needs to be uniform in an axial direction of the developing sleeve 13-1.

Figure 9:
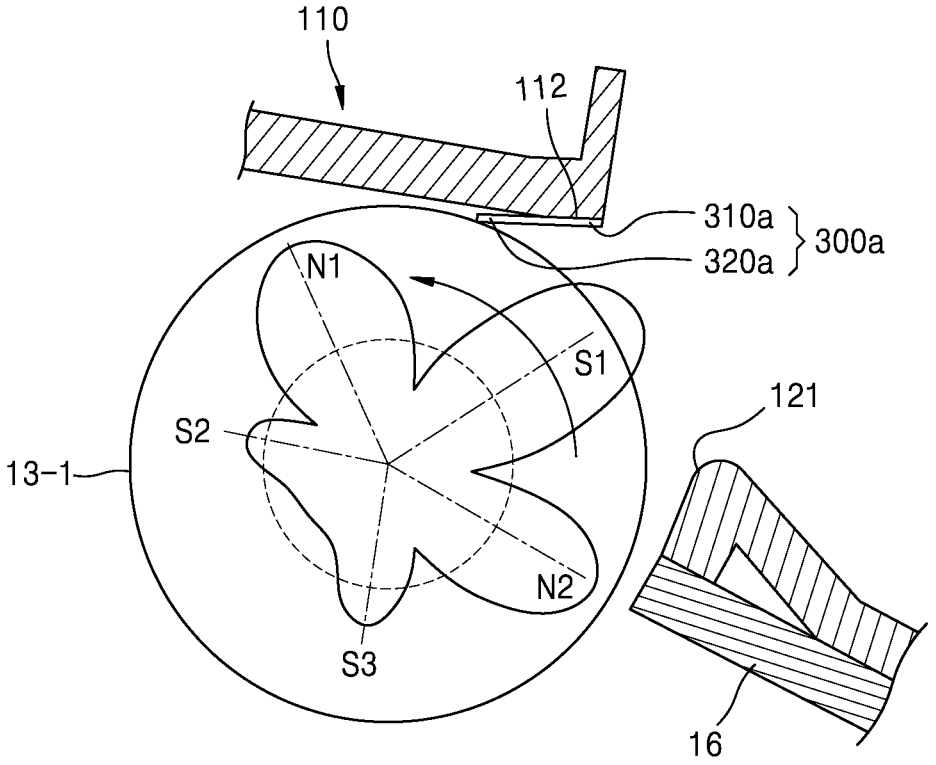
FIG. 9 illustrates an elastic member including a fixed portion and an extension portion located in a forward direction with respect to a rotation direction of a developing sleeve according to an example.

FIG. 9 illustrates an elastic member including a fixed portion and an extension portion located in a forward direction with respect to a rotation direction of a developing sleeve according to an example.

Referring to FIG. 9, an elastic member 300*a* including a fixed portion 310*a* and an extension portion 320*a* located in a forward direction with respect to the rotation direction R1 of the developing sleeve 13-1, is illustrated as a comparative example. When the elastic member 300*a* is formed of a thin film material, the shape of the elastic member 300*a* may not be uniform in the axial direction and may be partially deformed. In addition, because the bending degree of the extension portion 320*a* from the fixed portion 310*a* is low, a contact pressure between the extension portion 320*a* and the developing sleeve 13-1 may become non-uniform in the axial direction of the developing sleeve 13-1 due to a partial deformation of a portion of the housing 110 to which the fixed portion 310*a* is attached, e.g., warpage of an attachment portion 112.

Referring again to FIG. 8, the fixed portion 310 extends toward the developing sleeve 13-1 in a direction opposite to the rotation direction R1 of the developing sleeve 13-1. The fixed portion 310 is located in a reverse direction of the rotation direction R1 of the developing sleeve 13-1, and the extension portion 320 is located in the forward direction of the rotation direction R1 of the developing sleeve 13-1. An angle CA between a line L1 tangential to an outer circumferential surface of the developing sleeve 13-1 at the contact portion CP where the extension portion 320 contacts the developing sleeve 13-1 and a line L2 extending from the fixed portion 310 is 90 degrees or more. The extension portion 320 extends from the fixed portion 310 in the rotation direction of the developing sleeve 13-1 in an arc shape with a high degree of bending to be in contact with the developing sleeve 13-1. The high degree of bending of the extension portion 320 means that the elastic member 300 may be easily maintained in a uniform shape in the axial direction. Also, although the attachment portion 112 of the housing 110 to which the fixed portion 310 is attached is partially deformed, i.e., warped, the effect of the warpage on the contact pressure between the extension portion 320 and the developing sleeve 13-1 is relatively low, so that the shape of the elastic member 300 may be uniformly maintained in the axial direction of the developing sleeve 13-1. Therefore, the inflow of air through the space between the downstream edge 122 of the opening 120 and the developing sleeve 13-1 may be effectively reduced or blocked.

Referring again to FIG. 7, the height of the magnetic brush (MB) from the surface of the developing sleeve 13-1 is proportional to an absolute value of the magnetic flux density in the normal direction. Because the extension portion 320 is in contact with the magnetic brush MB on the developing sleeve 13-1 at the contact portion CP, the extension portion 320 is spaced apart from the developing sleeve 13-1 at a gap (marked as CG in FIG. 12) proportional to the height of the magnetic brush MB. Because the magnetic brush MB is compressed by an elastic force of the extension portion 320, an actual gap CG is less than the height of the magnetic brush MB. Through this gap CG, air is introduced into the housing 110 together with the developer.

As the height of the magnetic brush MB decreases, the amount of air inflow may decrease and an increase in air pressure inside the developing device 10 may be inhibited more effectively. According to this example, an absolute value of the magnetic flux density in the normal direction provided by the magnetic member 13-2 may be 30 millitesla (mT) or less at the contact portion CP between the extension portion 320 and the developing sleeve 13-1. When the above-described conditions are satisfied, the amount of air introduced into the housing 110 through the gap CG may be minimized. In order to adjust the amount of air introduced through the gap CG to be less than the amount of air discharged through the regulation gap RG as described above, the relationship RG≥CG needs to be satisfied. In addition, to prevent air from being compressed between the contact portion CP and the gap HG, the relationship HG≥CG needs to be satisfied. When the absolute value of the magnetic flux density in the normal direction by the magnetic member 13-2 is less than 30 mT at the contact portion CP, the relationships RG≥CG and HG≥CG may be satisfied. For example, the absolute value of the magnetic flux density in the normal direction may be adjusted to be 30 mT or less by locating the contact portion CP between the extension portion 320 and the developing sleeve 13-1 within ±10 degrees of a position CR where the absolute value of the magnetic flux density in the normal direction is minimized between the developing pole S1 and the conveying pole N1.

In this example structure, the thickness of the developer layer formed on the developing sleeve 13-1 may be minimized at the contact portion CP, and thus, the gap CG may also be minimized. Also, the thickness of the developer layer formed on the developing sleeve 13-1 may be less than the regulation gap RG at the contact portion CP. Therefore, the relationship RG≥CG is satisfied, and the air flow discharged from the developing device 10 is greater than the air flow introduced into the developing device 10, thereby minimizing or preventing an increase in internal pressure of the developing device 10. In addition, the thickness of the developer layer on the developing sleeve 13-1 may be less than the gap HG at the contact portion CP. Therefore, the relationship HG≥CG is satisfied and compression of air between the gap HG and the contact portion CP may be reduced or prevented. As a result, both RG≥CG and RG≥HG are satisfied to allow the amount of air discharged from the developing device 10 to be greater than the amount of air flowing into the developing device 10, thereby minimizing or inhibiting pressure increase inside the developing device 10.

Even when the position of the contact portion CP is determined to satisfy the above-described conditions, there is a need to minimize the gap CG. As the gap CG increases, the amount of air flowing through the gap CG increases, and thus the inner pressure of the developing device 10 may increase.

Figure 10:
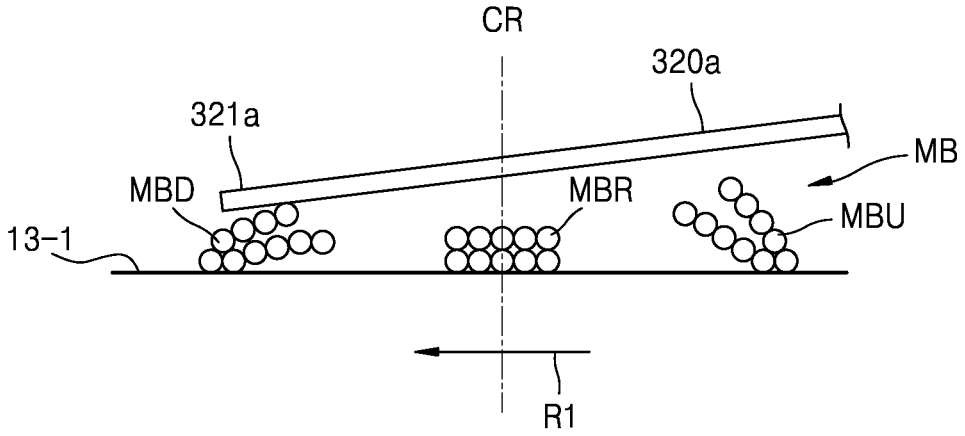
FIGS. 10 and 11 are schematic diagrams illustrating an unstable gap between a developing sleeve and an elastic member when the elastic member illustrated in FIG. 9 is used according to an example.
Figure 11:
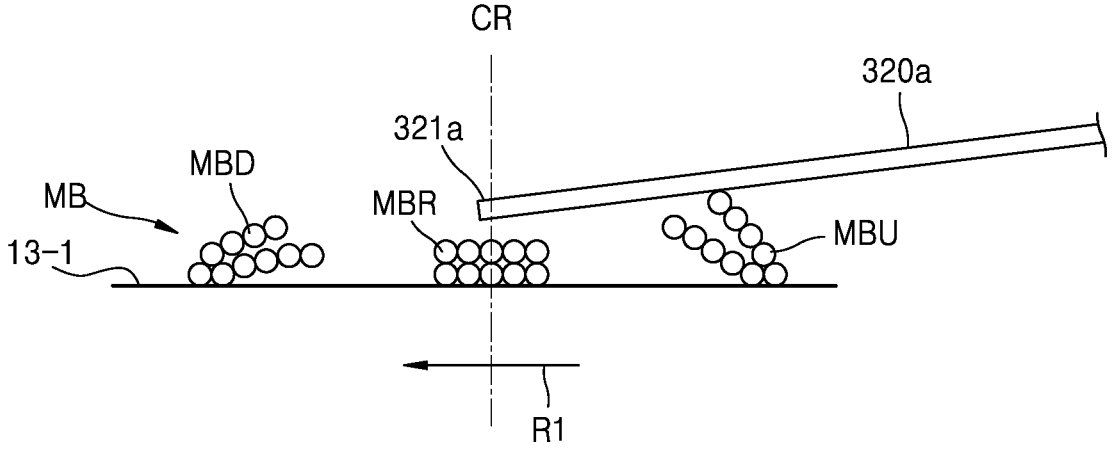

FIGS. 10 and 11 are schematic diagrams illustrating an unstable gap between a developing sleeve and an elastic member when the elastic member illustrated in FIG. 9 is used according to an example.

Referring to FIGS. 10 and 11, as the developing sleeve 13-1 rotates in the R1 direction, the magnetic brush MB moves in the R1 direction. The height of the magnetic brush MB formed on the surface of the developing sleeve 13-1 is the lowest at a position CR, where the absolute value of the magnetic flux density in the normal direction is minimized, and gradually increases toward the upstream side and the downstream side from the position CR. The gap between the extension portion 320*a* and the developing sleeve 13-1 depends on a contact state between the extension portion 320*a* and the magnetic brush MB. In order to minimize the gap between the extension portion 320*a* and the developing sleeve 13-1, the extension portion 320*a* should be in contact with a magnetic brush MBR.

FIG. 10 is a diagram illustrating a case in which one end 321*a* of the extension portion 320*a* is located beyond the position CR where the absolute value of the magnetic flux density in the normal direction is minimized. In this case, because the end 321*a* of the extension portion 320*a* is in contact with a magnetic brush MBD at the downstream side, the gap between the extension portion 320*a* and the developing sleeve 13-1 depends on the height of the magnetic brush MBD. FIG. 11 is a diagram illustrating a case in which one end 321*a* of the extension portion 320*a* is located at a position CR where the absolute value of the magnetic flux density in the normal direction is minimized. Because a magnetic brush MBU at the upper stream side is in contact with the extension portion 320*a*, the gap between the extension portion 320*a* and the developing sleeve 13-1 depends on a height of the magnetic brush MBU. As described above, the heights of the magnetic brush MBU and the magnetic brush MBD are greater than that of the magnetic brush MBR. Thus, it is difficult to minimize the gap between the extension portion 320*a* and the developing sleeve 13-1.

Figure 12:
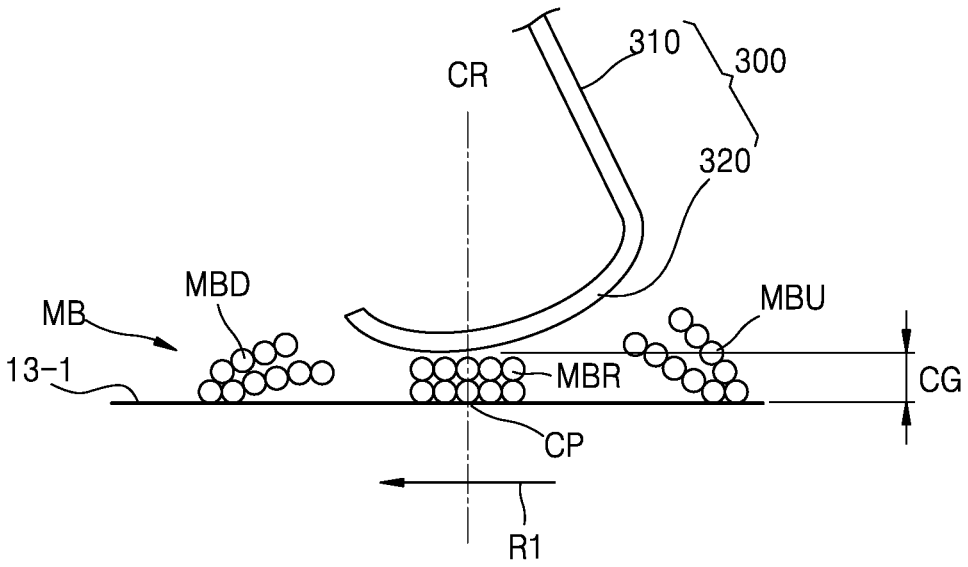
FIG. 12 is a diagram illustrating a gap between a developing sleeve and an elastic member according to an example.

FIG. 12 is a diagram illustrating a gap between a developing sleeve and an elastic member according to an example.

Referring to FIG. 12, the extension portion 320 extends from the fixed portion 310 in the rotation direction of the developing sleeve 13-1 in an arc shape with a high degree of bending to be in contact with the developing sleeve 13-1. Thus, the extension portion 320 is less likely to come into contact with the magnetic brush MBU and the magnetic brush MBD, and the extension portion 320 reliably contacts the magnetic brush MBR, thereby minimizing the gap CG.

The elastic member 300 may be an elastic film member. For example, the elastic member 300 may be formed of a polyethylene (PE) film. In this case, the elastic member 300 may have a thickness of 0.01 mm to 0.1 mm. When the thickness of the elastic member 300 is less than 0.01 mm, the elastic force is too low to decrease the height of the magnetic brush MB, and thus, the air flow introduced may increase. When the thickness of the elastic member 300 is greater than 0.1 mm, the elastic force is too high. When the elastic force of the elastic member 300 is too high, the magnetic brush MB may not be able to pass between the extension portion 320 and the developing sleeve 13-1 and may be caught by the extension portion 320, and thus, toner scattering may occur.

Figure 13:
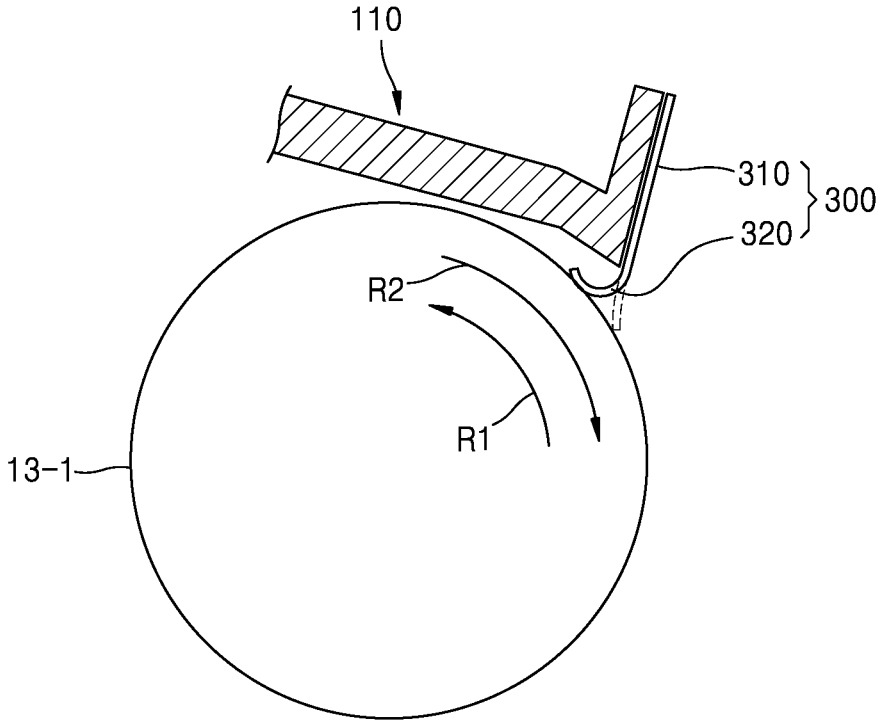
FIG. 13 is a diagram illustrating deformation of an elastic member based on a rotation direction of a developing sleeve according to an example.

FIG. 13 is a diagram illustrating deformation of an elastic member based on a rotation direction of a developing sleeve according to an example.

Referring to FIG. 13, when an image forming operation is performed, the developing sleeve 13-1 rotates in an R1 direction as shown by the solid line in FIG. 13. In this case, the extension portion 320 is bent from the fixed portion 310 in the R1 direction to be in contact with the developing sleeve 13-1 as shown by the solid line in FIG. 13. In some instances, the developing sleeve 13-1 may rotate in an R2 direction. In this case, the extension portion 320 is stretched in the R2 direction as shown by dashed lines in FIG. 13. In this state, when the developing sleeve 13-1 rotates in the R1 direction, an end of the extension portion 320 is caught by the developing sleeve 13-1 and the extension portion 320 is bent in the R1 direction again to be in contact with the developing sleeve 13-1. By locating the fixed portion 310 in the reverse direction of the rotation direction R1 of the developing sleeve 13-1, as described above, damage to the elastic member 300 may be prevented even when the developing sleeve 13-1 rotates in the reverse direction.

Figure 14:
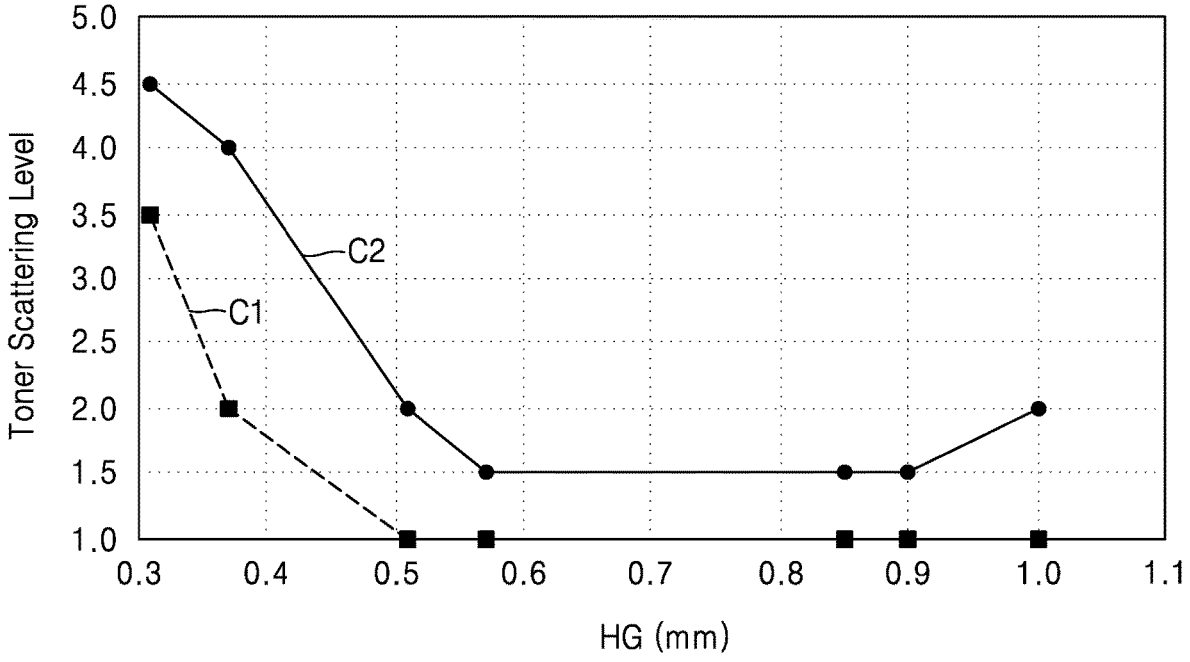
FIG. 14 is a graph illustrating results of observing toner scattering while changing a gap (HG) when an elastic member is used and not used according to an example.

FIG. 14 is a graph illustrating results of observing toner scattering while changing a gap (HG) when an elastic member is used and not used according to an example.

Referring to FIG. 14, the experimental conditions are as follows. After operating the developing device 10 for 90 minutes, toner scattering was evaluated by visual observation, and results were classified into five levels of Levels 1 to 5 (Level 1: good/Level 5: bad). As illustrated in FIG. 14, C1 is a case in which the elastic member 300 is used and C2 is a case in which the elastic member 300 is not used.

Process speed: 280 mm/sec (about 60 ppm)
Concentration of tone in developer: 9%
Amount of developer in developing device 10: 235 g
Air vents 141 and 142: both closed
Regulation gap RG: 0.64 mm
Gap HG: varying from 0.31 mm to 1.0 mm Referring to FIG. 14, it is illustrated that the degree of toner scattering when the elastic member 300 is used is less than that when the elastic member 300 is not used, regardless of changes in the gap HG. For example, when the gap HG is greater than 0.5 mm, toner scattering hardly occurs. Because the gap HG may be increased, the possibility of contact between the housing 110 and the developing sleeve 13-1, caused by deformation of the housing 110 and the like, may be reduced. Because the gap HG may be increased, there is no need to manage tolerance of the housing 110, thereby reducing manufacturing costs.

Figure 15:
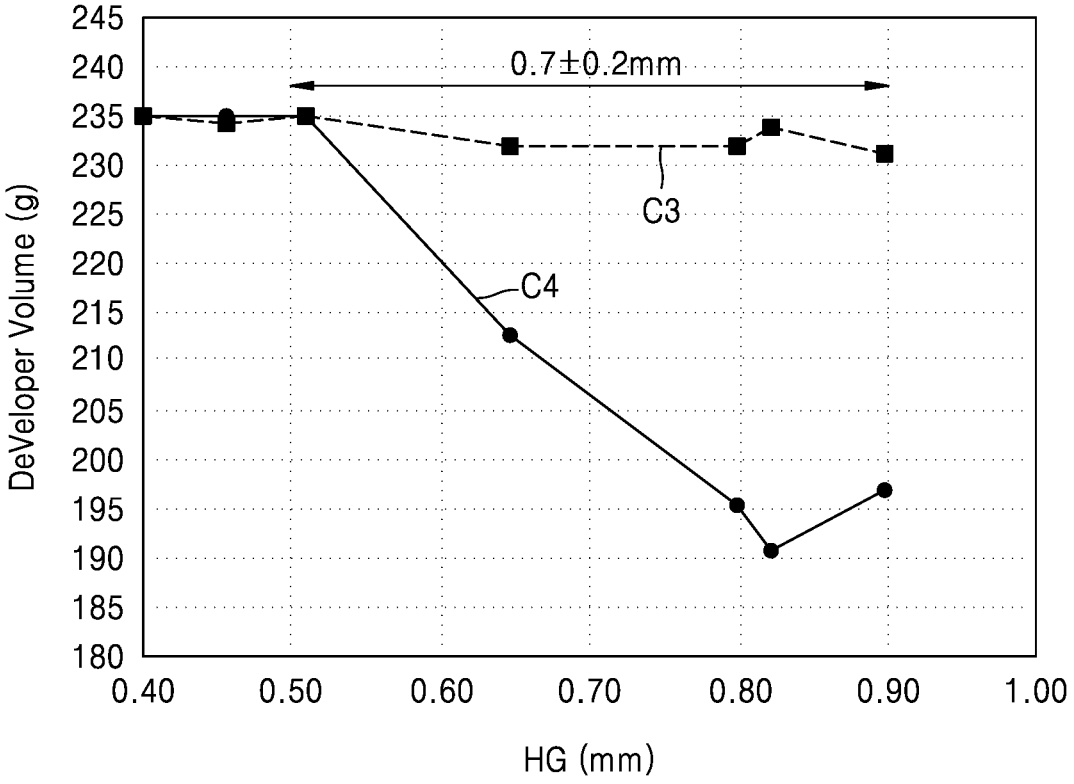
FIG. 15 is a graph illustrating results of measuring changes in an amount of a developer discharged through a developer outlet while changing a gap (HG) when an elastic member is used and not used according to an example.

FIG. 15 is a graph illustrating results of measuring changes in an amount of a developer discharged through a developer outlet while changing a gap (HG) when an elastic member is used and not used according to an example. Experimental conditions are as described above. After operating the developing device 10 for 90 minutes, the developing device 10 was stopped, and the amount of the developer contained in the developing device 10 was measured. In FIG. 15, C3 is a case in which the elastic member 300 is used and C4 is a case in which the elastic member 300 is not used.

Referring to FIG. 15, in the case in which the elastic member 300 is not used, when the gap HG is greater than 0.6 mm, the amount of the developer contained in the developing device 10 rapidly decreases. This is because a large amount of the developer is discharged with air through the developer outlet 260 due to a rapid increase in pressure inside the developing device 10. When the elastic member 300 is used, the amount of the developer contained in the developing device 10 is almost unchanged regardless of changes in the gap HG. This indicates that the pressure inside the developing device 10 is maintained substantially constant, and thus, the developer is not excessively discharged through the developer outlet 260.

Figure 16:
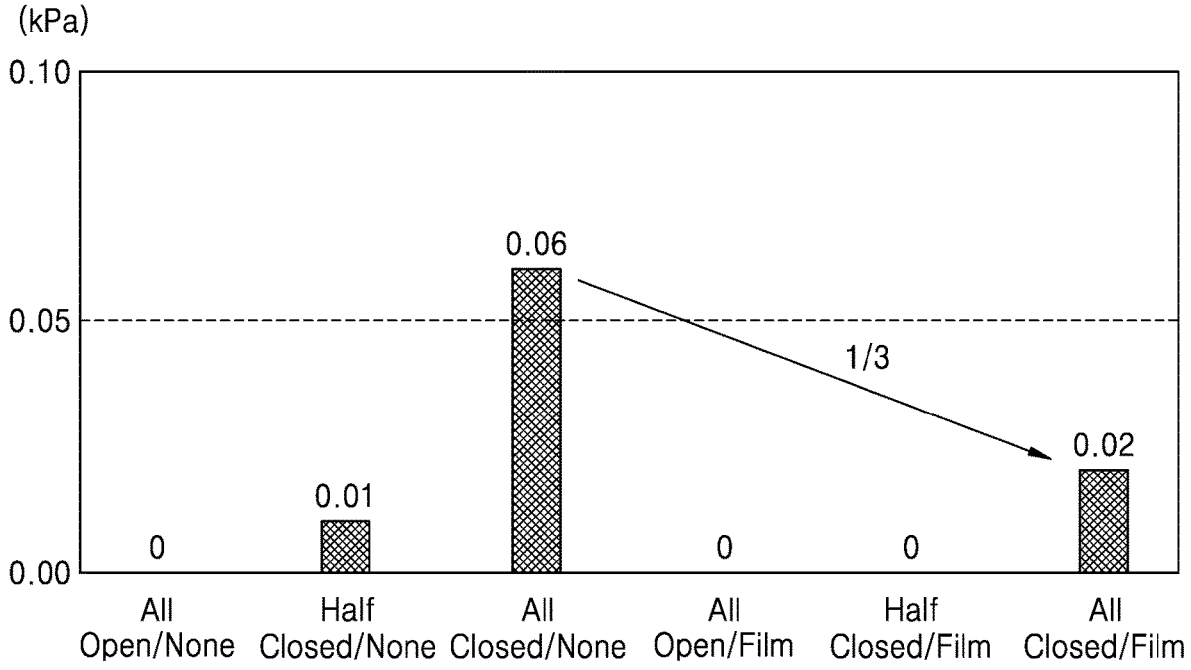
FIG. 16 is a graph illustrating results of measuring inner pressure of a developing device when an elastic member is used and not used according to an example.

FIG. 16 is a graph illustrating results of measuring inner pressure of a developing device when an elastic member is used and not used according to an example. Experimental conditions are as described above. The gap HG is 0.8 mm. All Open/None, Half closed/None, and All Closed/None are results of measuring inner pressures of the developing device 10 not using the elastic member 300 measured when both of the air vents 141 and 142 are opened, when one of the air vents 141 and 142 is closed, and both of the air vents 141 and 142 are closed, respectively. All Open/Film, Half closed/Film, and All Closed/Film are results of measuring inner pressures of the developing device 10 using the elastic member 300 when both of the air vents 141 and 142 are opened, when one of the air vents 141 and 142 is closed, and both of the air vents 141 and 142 are closed, respectively.

Referring to FIG. 16, in the All Closed state, the inner pressure of the developing device 10 is 0.06 kPa when the elastic member 300 is not used, and the inner pressure of the developing device 10 is 0.02 kPa when the elastic member 300 is used. Thus, it may be confirmed that the inner pressure of the developing device 10 decreases by about ⅓ by using the elastic member 300. Therefore, toner scattering caused by an increase in the inner pressure of the developing device 10 and excessive discharge of the developer through the developer outlet 260 may be prevented. It is assumed that the inner pressure of 0.02 kPa is generated by an air flow caused by rotation of the first and second conveying members 241 and 242.

It should be understood that examples described herein should be considered in a descriptive sense only and not for purposes of limitation. Descriptions of features or aspects within each example should typically be considered as available for other similar features or aspects in other examples. While one or more examples have been described with reference to the figures, it will be understood by those of ordinary skill in the art that various changes in form and details may be made therein without departing from the spirit and scope as defined by the following claims.

What is claimed is:

1. A developing device comprising:

a housing to contain a developer and having an opening;

a developing sleeve provided in the housing and partially exposed to an outside of the housing through the opening;

a magnetic member comprising a plurality of magnetic poles and located inside the developing sleeve;

an elastic member blocking an inflow of air through a space between a downstream edge of the opening in a rotation direction of the developing sleeve and an outer circumferential surface of the developing sleeve, wherein the elastic member comprises:

a fixed portion fixed to the housing at a position adjacent to the downstream edge of the opening; and an extension portion extending from the fixed portion and bent from the fixed portion in a forward direction with respect to the rotation direction of the developing sleeve to be elastically in contact with the outer circumferential surface of the developing sleeve; and a regulating member located at an upstream side of the opening in the rotation direction of the developing sleeve to regulate a thickness of the developer supplied to the opening, wherein the regulating member is spaced apart from the outer circumferential surface of the developing sleeve by a regulation gap, wherein the regulation gap is equal to or greater than a minimum gap between the housing and the developing sleeve at a downstream side of the opening in the rotation direction of the developing sleeve.

2. The developing device of claim 1, wherein an angle between a first line tangential to the outer circumferential surface of the developing sleeve at a contact portion where the extension portion contacts the developing sleeve and a second line extending from the fixed portion toward the developing sleeve is 90 degrees or more, the second line being along a length of the fixed portion, and the angle facing away from the developing sleeve and away from the extension portion.

3. The developing device of claim 1, wherein a magnetic flux density formed by the plurality of magnetic poles in a normal direction is 30 millitesla or less at a contact portion between the extension portion and the developing sleeve.

4. The developing device of claim 3, wherein the plurality of magnetic poles comprise a developing pole located to correspond to the opening and a conveying pole located at the downstream side of the opening, and wherein the extension portion is in contact with the developing sleeve between the downstream edge of the opening and the conveying pole.

5. The developing device of claim 4, wherein the extension portion is in contact with the developing sleeve within ±10 degrees of a position where an absolute value of the magnetic flux density in the normal direction is minimized between the developing pole and the conveying pole.

6. The developing device of claim 1, wherein the extension portion bending away from the fixed portion has an arc shape.

7. The developing device of claim 6, wherein the fixed portion is linear.

8. The developing device of claim 1, wherein the elastic member comprises a polyethylene film, and wherein a thickness of the polyethylene film is in a range of 0.01 millimeters (mm) to 0.1 mm.

9. The developing device of claim 1, further comprising a developer outlet to discharge a surplus of the developer contained in the housing.

10. A developing device comprising:

a housing to contain a developer, the housing comprising an opening and a developer outlet to discharge a surplus of the developer;

a developing sleeve provided in the housing and comprising a development region partially exposed to an outside of the housing through the opening;

a magnetic member located inside the developing sleeve to generate a magnetic force and comprising a developing pole located to correspond to the opening and a conveying pole located at a downstream side of the opening in a rotation direction of the developing sleeve, the conveying pole having an opposite magnetic polarity to that of the developing pole;

an elastic member comprising a fixed portion fixed to the housing at a position adjacent to a downstream edge of the opening, and an extension portion elastically in contact with the developing sleeve upstream of the conveying pole in the rotation direction of the developing sleeve, wherein the extension portion extends from the fixed portion and is bent from the fixed portion in a forward direction with respect to the rotation direction of the developing sleeve to be elastically in contact with an outer circumferential surface of the developing sleeve; and a regulating member located at an upstream side of the opening in the rotation direction of the developing sleeve to regulate a thickness of the developer supplied to the opening, wherein the regulating member is spaced apart from the outer circumferential surface of the developing sleeve by a regulation gap, wherein the regulation gap is equal to or greater than a minimum gap between the housing and the developing sleeve at the downstream side of the opening.

11. The developing device of claim 10, wherein a magnetic flux density in a normal direction provided by the magnetic member is 30 millitesla or less at a contact portion between the extension portion and the developing sleeve.

12. The developing device of claim 11, wherein the extension portion is in contact with the developing sleeve within ±10 degrees of a position where an absolute value of the magnetic flux density in the normal direction is minimized between the developing pole and the conveying pole.

13. The developing device of claim 10, wherein an angle between a first line tangential to the outer circumferential surface of the developing sleeve at a contact portion where the extension portion contacts the developing sleeve and a second line extending from the fixed portion toward the developing sleeve is 90 degrees or more, the second line being along a length of the fixed portion, and the angle facing away from the developing sleeve and away from the extension portion.

14. The developing device of claim 10, wherein the elastic member comprises a polyethylene film, and wherein a thickness of the polyethylene film is in a range of 0.01 mm to 0.1 mm.

15. The developing device of claim 10, wherein the extension portion bending away from the fixed portion has an arc shape, and the fixed portion is linear.

* * * * *